US005462484A

United States Patent [19]

Jung et al.

[11] Patent Number: 5,462,484

[45] Date of Patent: Oct. 31, 1995

[54] CLEAN-ROOM CEILING MODULE

[75] Inventors: Udo Jung, Bad Hersfeld; Herbert Eidam, Schenklengsfeld; Wilhelm Gerk, Eiterfeld, all of Germany

[73] Assignee: Babcock BSH Aktiengesellschaft Vormals Butner-Schilde-Haas AG, Krefeld, Germany

[21] Appl. No.: 162,012

[22] PCT Filed: Jun. 10, 1992

[86] PCT No.: PCT/EP92/01297

§ 371 Date: Nov. 30, 1993

§ 102(e) Date: Nov. 30, 1993

[87] PCT Pub. No.: WO93/01453

PCT Pub. Date: Jan. 21, 1993

[30] Foreign Application Priority Data

Jul. 8, 1991 [DE] Germany ..... 41 22 582.1

[51] Int. Cl.[6] ..... F24F 3/16

[52] U.S. Cl. ..... 454/187; 55/385.2; 55/423; 55/437; 55/473; 454/296; 454/906

[58] Field of Search ..... 454/234, 292, 454/296, 297, 298, 906, 187; 55/267, 385.2, 423, 437, 438, 440, 471, 473

[56] References Cited

U.S. PATENT DOCUMENTS

| | | | |
|---|---|---|---|
| 1,879,107 | 9/1932 | Couch | 55/440 X |
| 4,549,472 | 10/1985 | Endo et al. | 55/385.2 X |
| 4,560,395 | 12/1985 | Davis | 454/187 X |
| 4,810,269 | 3/1989 | Stackhouse et al. | 55/471 X |

FOREIGN PATENT DOCUMENTS

| | | | |
|---|---|---|---|
| 0196333 | 10/1986 | European Pat. Off. . | |
| 0202110 | 11/1986 | European Pat. Off. . | |
| 1105213 | 11/1955 | France | 55/440 |
| 8805774 | 8/1988 | Germany . | |
| 3836147 | 4/1990 | Germany . | |
| 1641401 | 4/1991 | U.S.S.R. | 55/440 |

*Primary Examiner*—Harold Joyce
*Attorney, Agent, or Firm*—Herbert Dubno

[57] ABSTRACT

A module for the construction of a cleaning room ceiling has a housing which can be fitted like a tile in the ceiling and which is divided internally into three chambers. A fan in an upper false floor draws air into the housing along an upper chamber which is aligned with a sound-damping lining. Sound-damping baffles are provided on the underside of the upper floor and the upper side and lower floor in the intermediate chamber and the bottom of the lower chamber is closed by high efficiency particle filters.

9 Claims, 3 Drawing Sheets

CLEAN-ROOM CEILING MODULE

CROSS REFERENCE TO RELATED APPLICATION

This application is a national phase application corresponding to PCT/EP92/01297 filed Jun. 10, 1992 and based in turn on German national application P41 22 582.1 filed Jul. 8, 1991 under the International Convention.

FIELD OF THE INVENTION

The invention relates to a clean-room ceiling module with a laminar air flow technology, with three superimposed chambers separated by two false floors, whereby the chambers are interconnected by openings alternately arranged in the false floors, the upper chamber has a return-air opening in the module ceiling on the side opposite to the opening in the upper false floor.

Certain production processes, for example in micro-electronics, precision mechanics, optics or in the pharmaceutical industry, require clean, dust-free atmospheres, which require the technology of clean-room installations. In the so-called laminar air flow technology the clean atmosphere is produced by passing high-grade filtered air in a low-turbulence displacement flow through the clean room.

In the clean-room installation based on laminar air flow technology described in the EP-A 2 0 202 110 air under pressure is supplied by fans in a chamber between the ceiling and a false ceiling formed by high-efficiency filters. The air purified by the high-efficiency filters traverses the clean room vertically downwardly, is aspirated from the clean room through lateral channels. In this installation the elements of clean-room technology are fixedly mounted.

Since the production conditions in many fields change with increasing rapidity, there is a great deal of interest in clean-room systems which can be quickly assembled and disassembled, wherein new clean rooms can be quickly set up, old ones can be removed or already existing ones can be enlarged or reduced in size.

This has led to the development of modular systems.

EP-Al 0 196 333 for instance describes a clean-room system is which has a false ceiling with a support system and ceiling modules, which are designed as filter-fan modules, return-air modules and as blind modules. Through different arrangements of the various ceiling modules, zones with different degrees of cleanliness are set up.

A further clean-room system with various ceiling modules is described in the brochure "Flexi-Reinraum". This system is also suited only to set up smaller areas based on the laminar air flow technology with a higher degree of cleanliness, i.e. Class 100 or under, within a larger clean room. An arrangement of several rows of filter-fan modules (filter-fan modules) is not possible due to space restrictions.

A precondition of the laminar flow in the clean room is an even speed distribution downstream of the high-efficiency particulate air filters, must be generated by a uniform flow into the filters.

The high-efficiency particulate air filters have very high air resistances and considerably reduce the flow velocity. Therefore only the static pressure fraction of the air flow upstream of the high-efficiency particulate air filter is effective.

The laminar air flow technology requires therefore an air flow with the lowest possible turbulence and with the highest possible static pressure fraction in the chamber before the high-efficiency particulate air filters.

A low-turbulence flow is favored by a one-sided air supply to this chamber before the high-efficiency particulate air filters. The static pressure fraction of a flow can be increased through the transformation of dynamic pressure into static pressure.

Such a transformation is achieved by guiding the air through a chamber system with several chambers, thereby reducing the flow velocity.

From DE-U 88 05 774 such a chamber system is known with so-called tunnel modules, which can be arranged in a row one after the other for the construction of clean rooms with laminar air flow technology with the highest degree of cleanliness.

A tunnel module consists of an upper part and two lateral walls. The upper part has a chamber system with a return-air opening, a fan and superimposed chambers, whereby the lower chamber is defined by high-efficiency particulate air filters arranged like tiles. The air is guided through the chamber system and introduced into the clean room through the filters.

During the passage of the air through the chamber system with several chambers the desired transformation of dynamic pressure into static pressure takes place, thereby causing a reduction of the flow velocity upsteam of the high-efficiency particulate air filters. With the tunnel modules smaller and medium-sized clean rooms can be quickly assembled and disassembled, expanded or reduced in size. They are particularly suited for retrofitting already existing buildings. However, in the case of new buildings it is preferable to eliminate the double walls, namely the ones of the tunnel modules and the ones of the building, and not limit the clean room to the width of the tunnel modules.

Another module for the construction of a clean-room ceiling is known from the DE-OS 38 36 147.

OBJECT OF THE INVENTION

It is the object of the invention to provide an improved module which in conditions of good flow guidance, as well as with the smallest possible overall dimensions, affords good sound reduction.

SUMMARY OF THE INVENTION

This object is achieved with a ceiling module wherein in the middle chamber under the opening of the upper false floor a fan is arranged, the lower chamber being limited at the bottom by high-efficiency filters and in the upper two chambers devices for sound reduction are provided. According to the invention the return-air opening in the ceiling of the module starts from the lateral wall and extends over 20 to 30% of its length and over its entire width of the module. In the upper chamber the ceiling and the upper false floor are provided with sound-damping linings. In the middle chamber, the false floors are provided with sound-damping baffles and in the lower chamber the lower false floor is provided with a sound-absorption plate.

Due to the tile-like arrangement of the modules of the invention in a framework, a clean-room ceiling based on the laminar air flow technology can be built. The modules can be assembled to form a clean-room ceiling of any desired size, whereby it is possible to replace in a simple way one individual module, e.g. for maintenance purposes.

Through the return-air opening in the ceiling of the module, the return air is aspirated from the plenum between the clean-room ceiling and the housing ceiling, and guided to the fan through the upper chamber provided with sound-damping devices. The size of the return-air opening is selected so that on the one hand the flow velocity is not too high, which would be the case with a small opening, and on the other hand so that the stretch traversed in the upper chamber is sufficiently long for sound reduction.

This combination of a sound-damping lining in the upper chamber, sound-damping baffles in the intermediate chamber and sound-absorption plates in the lower chamber, makes possible a good sound reduction even with small overall dimensions of the module and a low weight of the sound insulation devices compared to the corresponding size of the tunnel module.

By replacing the sound-damping baffles in the upper chamber with sound-damping linings and an additional sound-absorption plate in the lower chamber it is possible to reduce the height of the upper chamber and the height of the sound-damping baffles in the intermediate chamber, thereby reducing the height of the intermediate chamber and the weight of all the sound-damping devices.

Reduced height and reduced weight are an enormous advantage in the use of modules for the construction of a clean-room ceiling. It translates into lower demands on the frame structure bearing the modules.

According to the invention, in the middle chamber the lower sound-damping baffle is rounded towards the opening in the lower false floor. In the middle chamber the upper sound-damping baffle can fill the corner between the upper false floor and the lateral wall above the opening, whereby the corner is rounded towards the middle chamber.

The opening is provided with at least one rounded rectifier baffle which starting from the middle chamber above the lower sound-damping baffle reaches through the opening into the lower chamber. The distance of the rectifier baffle to the lower sound-damping baffle and optionally the distance of the rectified baffles from each other increases along their path from the middle chamber to the lower chamber. The rectifier baffle can be arranged above the lower sound-damping baffle at a level of 25 to 40% of the width of the gap remaining between the lower and upper sound-damping baffles.

Two rectifier baffles can be provided whereby the first rectifier baffle is arranged at a height of 20 to 30% and the second rectifier baffle is arranged at a height of 50 to 60% of the height of the gap remaining between the lower and upper sound-damping baffles. The second rectifier baffle towards the latter wall can reach to a lesser extent into the lower chamber than the first rectifier baffle.

These features influence the air flowing through the intermediate chamber into the lower chamber so that an air flow with lowest possible turbulence with the highest possible static pressure fraction is generated in the chamber upstream of the high-efficiency particulate air filters.

The sound-damping baffles rounded towards the opening, as well as the upper sound-damping coulisse rounded at the corner between the upper false floor and lateral wall 3 prevent turbulence at the return of the air flow from the intermediate chamber through the opening in the lower chamber.

The result is an improvement of the transformation of dynamic pressure into static pressure with the lowest possible loss.

The fan can be built in two parts, whereby its inlet is fastened to the upper false floor and its motor of the external rotor type is fastened via vibration dampers to the lower false floor.

The essential advantage of the fan consisting of two parts, whose motor is mounted in the module via vibration dampers, is that in a clean room built with clean-room ceiling modules there are hardly any vibrations caused by the fans.

Besides in this type of fan there are no flow obstructions such as stay bolts connecting the motor plate with the inlet.

In the upper chamber over the inlet, a rectifier baffle can run parallel to the front and rear walls from the lateral wall beyond the middle of the inlet.

The rectifier baffle leads to a uniform air flow in the upper chamber above the fan.

Above the inlet there can be an opening in the ceiling for the supply of conditioned air.

Such modules are particularly suited for the construction of ceilings for clean rooms requiring climate-control.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
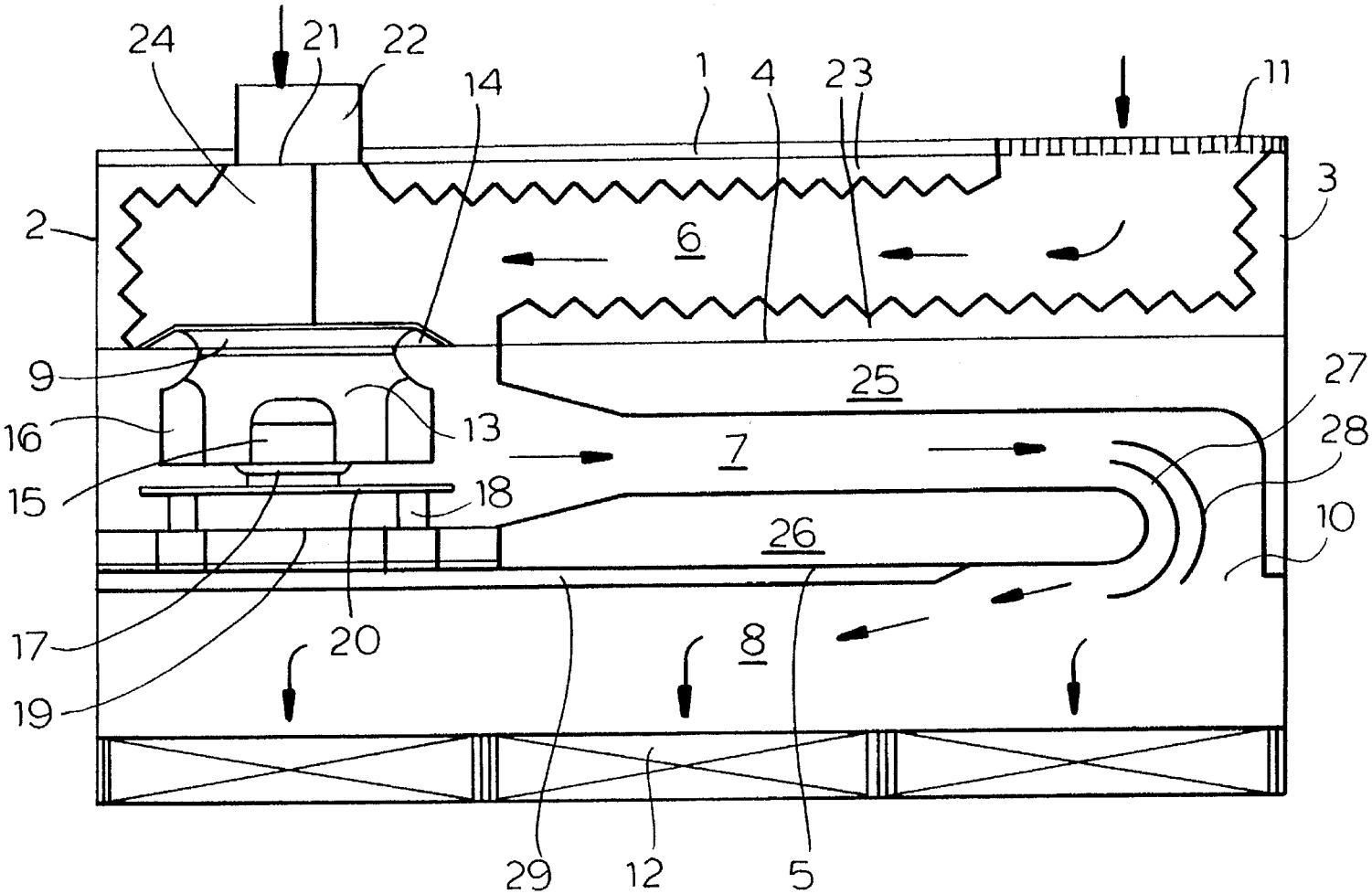
FIG. 1 is a diagrammatic vertical section through a module of a first embodiment.

A first embodiment of a module for the construction of a clean-room ceiling has a housing in the shape of a parallelepiped with a rectangular base, whereby its ceiling 1, its lateral walls 2, 3, as well as its front and rear walls not shown in the drawing and parallel to the drawing plane consist of beveled plates.

The module is subdivided by two false floors 4, 5 into three flat chambers 6, 7, 8 in superimposed levels, which extend over the entire width (perpendicular to the drawing plane in FIG. 1). The chamber heights of the three chambers 6, 7, 8 are approximately equal. The chambers 6, 7, 8 are interconnected by alternately arranged openings 9, 10.

The upper chamber has in the ceiling 1 a return-air opening 11 covered by a grid or an adjusting flap, extending from the lateral wall 3 over a fifth to a fourth of the module length and over its entire width. The opening 9 of the upper false floor 4 is located in the proximity of lateral wall 2 opposite to the return-air opening 11. The opening 10 of the lower false floor 5 is a gap which remains clear between the edge of the lower false floor 5, which does not reach all the way to the lateral wall 3, and the lateral wall 3.

The lower chamber 8 is limited at the bottom by three high-efficiency particulate air filters 12 arranged in a row, whereby the high-efficiency particulate air filters 12 rest against the beveled edges of the lateral walls 2, 3, the front and rear wall. The high-efficiency particulate air filters 12 are built in with packing and sealing material.

In the intermediate chamber 7 there is a fan 13, which is designed as a radial fan without a housing and with a motor 15 of the external rotor type and has blades 16 which are curved backwards. The fan 13 is divided in two parts, whereby its inlet 14 sits in the opening 9 of the upper false floor 4 and is fastened to the upper false floor 4 and its motor 15 of the external rotor type is mounted to the lower false floor 5. The distance between the fan axle 17 and the closest lateral wall 2 equals approximately 0.8 times the diameter of fan 13. Its distance to the front wall equals approximately 40% of the module width.

The motor 15 of the external rotor type of fan 13 is mounted via four flexible rubber elements 18 on a plate 20 fastened to a rectangular frame 19. The frame 19 is securely screwed to the false floor 5 via small 5 mm thick mounting plates (which are not shown in the drawing) in four points close to the lateral wall 2, the front and rear walls.

In the ceiling 1 of the module , exactly above the inlet 14, there is a further opening 21 with a a connection piece 22 to which a feeding duct for conditioned air can be connected. In the area of the opening 21 a portion of the ceiling 1 can be removed for the maintenance of the fan 13.

In the upper chamber 6, the ceiling 1, the upper false floor 4 and the lateral walls 2, 3 are covered by a sound-damping lining 23, e.g. sound-damping plates made of plastic foam and having a pyramidally or honeycomb structured surface.

The sound-damping lining 23 at the ceiling 1 reaches from the return-air opening 11 to the lateral wall 2, whereby the opening 21 is exempted, and at the upper false floor 4 from the lateral wall 3 close to the inlet 14. The thickness of the sound-damping lining 23 on each side equals approximately one fourth of the height of the upper chamber 6, so that between them remains a gap whose height equals approximately half of the chamber height.

In the upper chamber 6, centrally above the inlet 14, there is a rectifier baffle 24, which is parallel to the front and rear walls. It extends from the lateral wall 2 across the inlet 14 somewhat beyond its middle.

In the middle chamber 7, to both false floors 4, 5 defining the middle chamber 7, sound-damping baffles 25, 26 are fastened, which extends from the fan 13 towards the lateral wall 3. The upper sound-damping baffle 25 reaches the lateral wall 3, fills the corner between the upper false floor 4 and the lateral wall 3 to the level of the lower false floor 5. The lower sound-damping baffles 26 reaches to the opening 10. The height $H_1$ of the sound-damping baffles 25, 26 at the false floors 4, 5 and the height $H_2$ of the gaps remaining between them each equal approximately one third of the chamber height, whereby the height $H_2$ of the gap is slightly bigger, e.g. by a factor of 1.2, than the height H, of the sound-damping baffles 25, 26. The width of the upper sound-damping baffles 25 at the lateral wall 3 amounts approximately to only one fourth of its height H, at the upper false floor 4.

Due to an inclined path of the sound-damping baffles 25, 26 at their ends directed towards the fan 13, the gap remaining between them opens towards the fan until it almost doubles its height. The lower sound-damping baffles 26 is rounded at its end facing the lateral wall 3, whereby the cross section of the end forms a semicircle around a center $M_1$ located at half the height $H_1$.

The sound-damping baffles 25, 26 are covered by a smooth, abrasion-resistant glass fiber quilt and filled with mineral wool.

Between the end of the lower sound-damping baffle 26 and the lateral wall 3 two rectifier baffles 27, 28 are arranged next to each other, extending from the front wall to the rear wall. Their cross sections describe arcs of circles, whereby the common center $M_2$ of their arcs of circles is slightly offset from the center $M_1$ towards the false floor 5.

Figure 2:
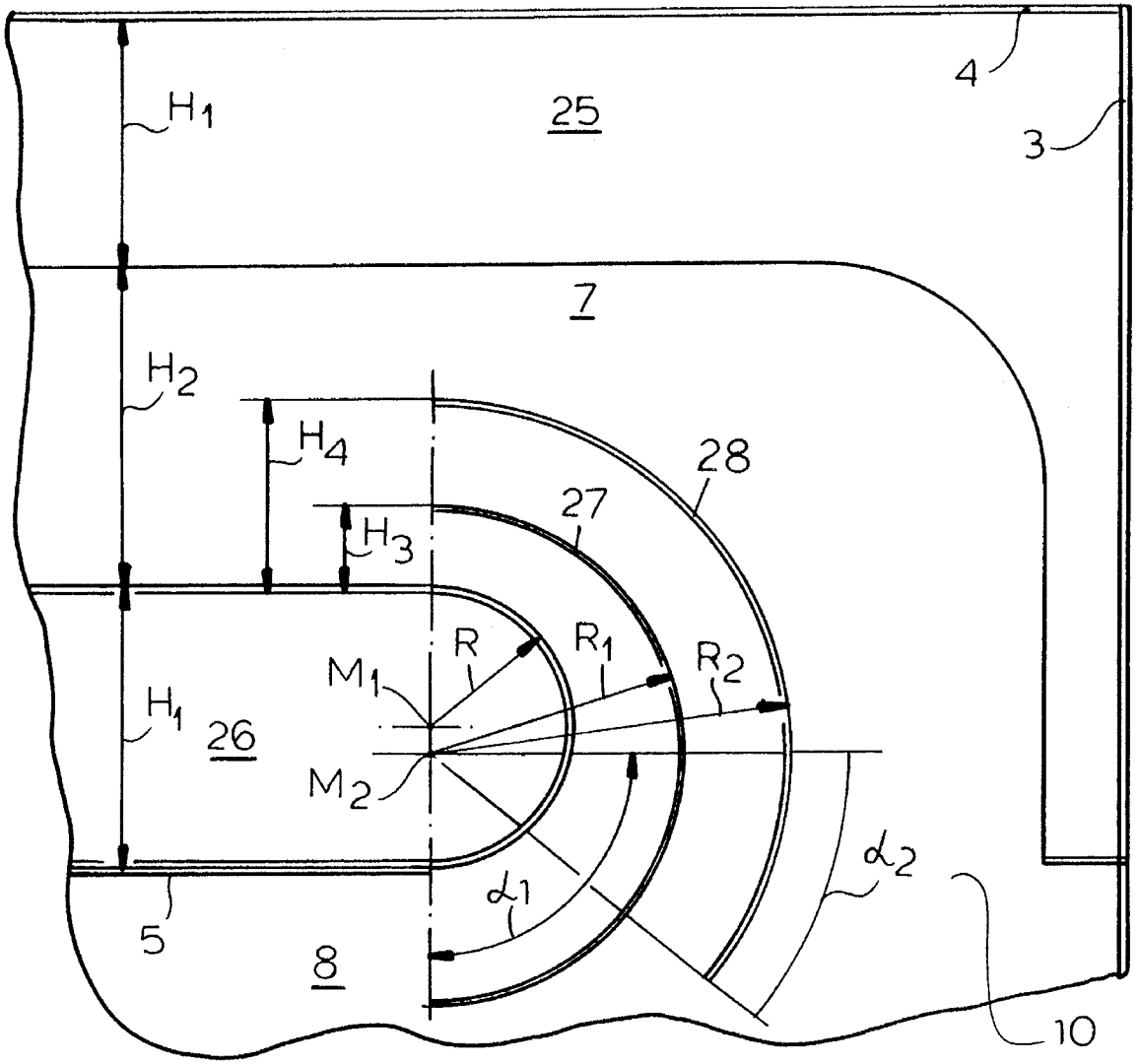
FIG. 2 is an enlarged detail of FIG. 1 in the area around the opening connecting the intermediate and the lower chambers.
Figure 3:
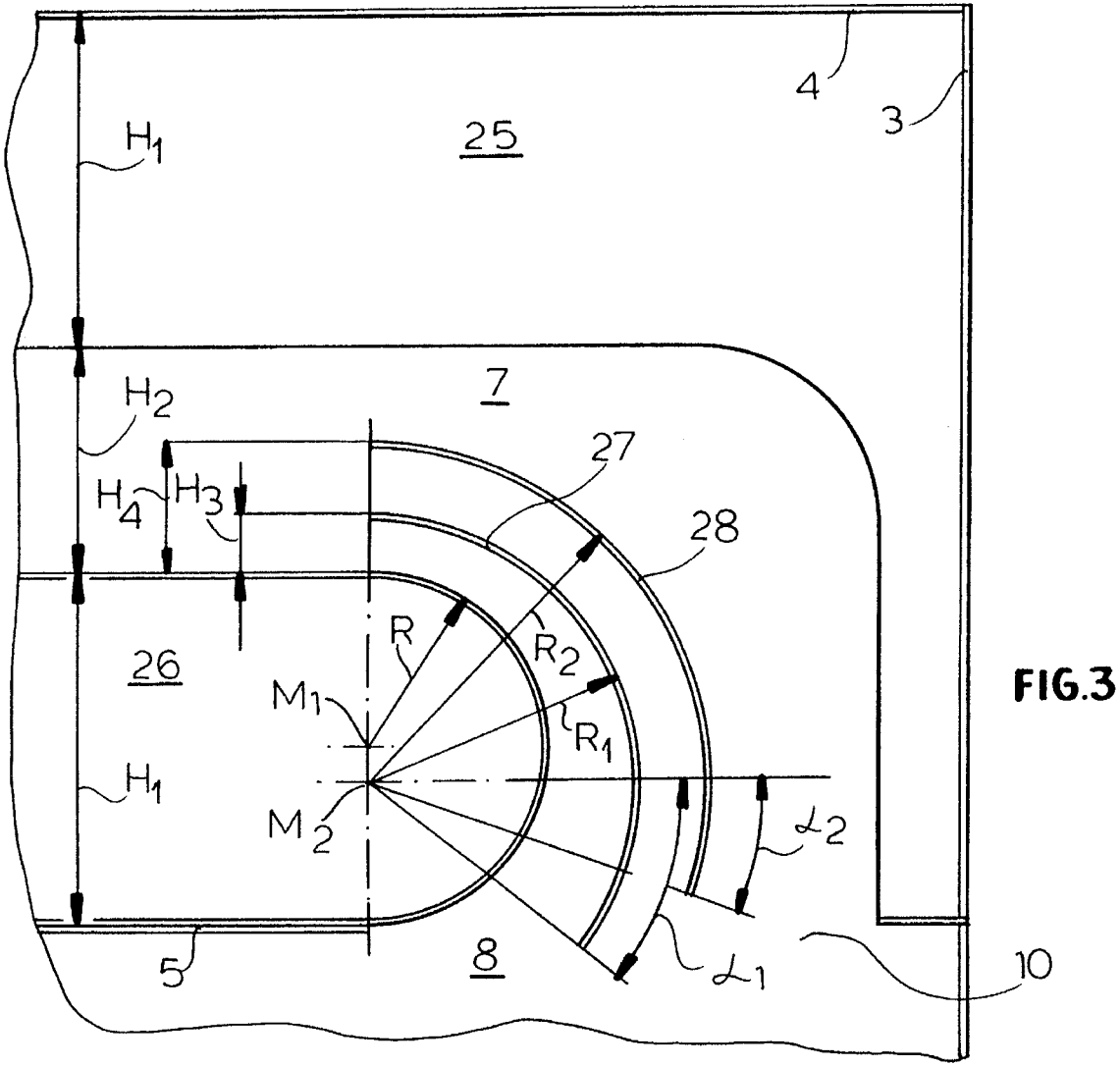
FIG. 3 is a view corresponding to FIG. 2 for a module of second embodiment.

The circular arc of rectifier baffle 27 arranged in front of the end of the lower sound-damping coulisse 26 starts vertically above the centers $M_1$, $M_2$ in the gap between the sound-damping coulisses 25, 26 and runs through the opening 10 into the lower chamber 8. It forms a complete semicircle, i.e. the angle δ1 shown in FIG. 2 between a horizontal line passing through the center $M_2$ and the end of the arc of circle equals 90°.

The circular arc of the second rectifier baffle 28 starts vertically above the the beginning of the circular arc of the first rectifier baffle 27 and passes also through the opening 10 into the lower chamber 8. However it form only an arc of circle of approximately 120°; thus the angle δ2 is only 40° C. and ends slightly higher than the circular arc of the first rectifier baffle 27 in the lower chamber 8.

The height $H_3$ of the gap between the lower sound-damping baffle 26 and the beginning of the rectifier baffle 27 can amount to 25 to 40% of the gap width but also can be about 20 to 30%, e.g. 25%, of the total height $H_2$ of the gap, and the height $H_4$ of the gap between the lower sound-damping baffle 26 and the beginning of the rectifier baffle 28 amounts to about 50 to 66%, e.g. 58% of the total height of the gap. The difference between the radius $R_2$ of the rectifier baffle 28 and the radius $R_1$ of the rectifier baffle 27 corresponds to the difference between the height $H_4$ and $H_3$.

In the lower chamber 8, the lower false floor 5 is covered with a sound-absorption plate 29. The sound-absorption plate 29 extends from the lateral wall 2 close to the opening 10, which it does not reach, but in whose direction it is bevelled. The sound-absorption plate 29 consists of several layers, e.g. of a layer made of plastic foam and of a bituminous layer.

The air flow direction is indicated by arrows. The free inner spaces of the upper chamber 6 and the middle chamber 7 form a hairpin-shaped air channel. In the area of the lateral wall 2, the air channel in the middle chamber 7 is branched into three channels by the two rectifier baffles 27, 28. The branching continues in the opening 10 of the lower false floor 5 and in a small area, adjacent thereto, of the lower chamber 8.

In order to build a clean-room ceiling, the modules are arranged over the entire surface of the clean-room ceiling next to each other, like tiles, in a grid-like frame structure.

In operation return air from the plenum between the clean-room ceiling and the ceiling of the building is aspirated via the return-air opening 11 and the upper chamber 6, as well as conditioned air via opening 21, and is supplied to the clean room through the middle and lower chambers 7, 8, via high-efficiency particulate air filters 12. The cleansed air traverses the entire clean room in a laminar flow.

EXAMPLE 2:

A module of the Example 2 differs from a module of Example 1 in that it has not three, but only two high-efficiency particulate air filters 12. Its base cross section is therefore square and the length of its chambers amounts to only two thirds of the chamber lengths of the module of Example 1. The width and height of the module and the height of chambers 6, 7, 8 correspond to the one of the module in Example 1.

However, in the middle chamber 7 the height $H_2$ of the gap between the lower and upper sound-damping coulisses 26, 25 is smaller than the $H_1$ of the sound-damping coulisses 25, 26. The height $H_2$ amounts in this Example to two thirds of the height $H_1$.

The module of Example 2 differs from the module of Example 1 also in that the rectifier baffles 27, 28 do not reach as far into the lower chamber 8 as in the latter, whereby the angles δ1 and δ2 assume values of for instance 40° C. and 20° C. The height $H_3$ also equals 25% and the height $H_4$ equals 50% of the total height $H_2$.

We claim:

1. A module for construction of a clean-room ceiling with lamina air flow technology, comprising:

a generally rectangular housing having a ceiling and lateral walls;

upper and lower vertically spaced horizontal false floors in said housing defining an Upper chamber, an intermediate chamber and a lower chamber in said housing, the upper false floor having a communicating Opening at one side of said housing interconnecting said upper and intermediate chambers, said lower false floor terminating at a gap from a one of said lateral walls at an opposite side of said housing to interconnect said intermediate chamber and said lower chamber;

a fan in said intermediate chamber at said communication opening for inducing flow into said housing, through said upper chamber and said intermediate chamber and into said lower chamber;

means forming a return air opening in a ceiling of said housing at said opposite side thereof;

a plurality of high efficiency filters formed at a bottom of said housing and communicating with said lower chamber, said return air opening extending from a lateral wall of said housing at said opposite side and extending over 20–30% of a length of said housing toward said one side and over an entire width of said housing;

a sound-damping lining along an underside of said ceiling and upper surface of said upper floor;

sound-damping baffles on a lower side of said upper floor and an upper side of said lower floor defining a flow space between them extending to said gap in said intermediate chamber;

a sound-absorption plate on a lower side of said lower floor in said lower chamber; and at least one arcuate rectifier baffle in said gap starting from said intermediate chamber above the sound-damping baffle on said upper side of said lower floor and reaching through said gap into said lower chamber.

2. The module defined in claim 1 wherein a spacing of said rectifier baffle from said sound-damping baffle on said upper side of said lower floor increases along a path of air flow from said intermediate chamber to said lower chamber through said gap.

3. The module defined in claim 2 wherein a second rectifier baffle is spaced from the first-mentioned rectifier baffle in said gap and a spacing of said rectifier baffles from one another increases along said path.

4. The module defined in claim 1 wherein said rectifier baffle is spaced above said sound-damping baffle on said upper side of said lower floor by a distance equal to 25 to 40% of the width of said flow space remaining between said sound-damping baffle.

5. The module defined in claim 3 wherein one of said rectifier baffles is disposed at a height of 20 to 30% and the other of said rectifier baffles is disposed at a height of 50 to 60% of said flow space between said sound-damping baffles.

6. The module defined in claim 3 wherein one of said rectifier baffles reaches into said lower chamber to a lesser extent than the other rectifier baffle.

7. The module defined in claim 1 wherein said fan is constructed in two parts with an inlet fastened to said upper floor and a motor driving an external rotor fastened by vibration dampers to said lower floor.

8. A module for construction of a clean-room ceiling with laminar air flow technology, comprising:

a generally rectangular housing having a ceiling and lateral walls;

upper and lower vertically spaced horizontal false floors in said housing defining an upper chamber, an intermediate chamber and a lower chamber in said housing, the upper false floor having a communicating opening at one side of said housing interconnecting said upper and intermediate chambers, said lower false floor terminating at a gap from a one of said lateral walls at an opposite side of said housing to interconnect said intermediate chamber and said lower chamber;

a fan in said intermediate chamber at said communication opening for inducing flow into said housing, through said upper chamber and said intermediate chamber and into said lower chamber;

means forming a return air opening in a ceiling of said housing at said opposite side thereof;

a plurality of high efficiency filters formed at a bottom of said housing and communicating with said lower chamber, said return air opening extending from a lateral wall of said housing at said opposite side and extending over 20–30% of a length of said housing toward said one side and over an entire width of said housing;

a sound-damping lining along an underside of said ceiling and upper surface of said upper floor;

sound-damping baffles on a lower side of said upper floor and an upper side of said lower floor defining a flow space between them extending to said gap in said intermediate chamber;

a sound-absorption plate on a lower side of said lower floor in said lower chamber; and a rectifier baffle extending over said inlet from said lateral wall at said one side perpendicular thereto and beyond a middle of said inlet.

9. A module for construction of a clean-room ceiling with lamina air flow technology, comprising:

a generally rectangular housing having a ceiling and lateral walls;

upper and lower vertically spaced horizontal false floors in said housing defining an upper chamber, an intermediate chamber and a lower chamber in said housing, the upper false floor having a communicating opening at one side of said housing interconnecting said upper and intermediate chambers, said lower false floor terminating at a gap from a one of said lateral walls at an opposite side of said housing to interconnect said intermediate chamber and said lower chamber;

a fan in said intermediate chamber at said communication opening for inducing flow into said housing, through said upper chamber and said intermediate chamber and into said lower chamber;

means forming a return air opening in a ceiling of said housing at said opposite side thereof;

a plurality of high efficiency filters formed at a bottom of said housing and communicating with said lower chamber, said return air opening extending from a lateral wall of said housing at said opposite side and extending over 20–30% of a length of said housing toward said one side and over an entire width of said housing;

a sound-damping lining along an underside of said ceiling and upper surface of said upper floor;

sound-damping baffles on a lower side of said upper floor and an upper side of said lower floor defining a flow space between them extending to said gap in said intermediate chamber;

a sound-absorption plate on a lower side of said lower floor in said lower chamber; and a rectifier baffle extending over said inlet from said lateral wall at said one side perpendicular thereto and beyond a middle of said inlet; and an opening formed in said ceiling above said inlet for supplying conditioned air to said housing.

* * * * *